US007220219B2

(12) United States Patent
Papadopoulos et al.

(10) Patent No.: US 7,220,219 B2
(45) Date of Patent: May 22, 2007

(54) BICYCLE TREADMILL HAVING AUTOMATIC SPEED AND RESISTANCE ADJUSTMENTS

(75) Inventors: Larry C. Papadopoulos, North Plains, OR (US); Jennifer D. Hole, North Plains, OR (US)

(73) Assignee: BCI Manufacturing, Inc., North Plains, OR (US)

( * ) Notice: Subject to any disclaimer, the term of this patent is extended or adjusted under 35 U.S.C. 154(b) by 0 days.

(21) Appl. No.: 10/682,257

(22) Filed: Oct. 7, 2003

(65) Prior Publication Data

US 2005/0164843 A1 Jul. 28, 2005

(51) Int. Cl.
*A63B 22/06* (2006.01)
*A63B 21/005* (2006.01)

(52) U.S. Cl. ..... 482/57; 482/54; 482/6

(58) Field of Classification Search ..... 482/51, 482/52, 54, 4–9, 901, 908, 57
See application file for complete search history.

(56) References Cited

U.S. PATENT DOCUMENTS

| | | | | | |
|---|---|---|---|---|---|
| 0,602,546 | A | | 4/1898 | Tarver | 482/61 |
| 0,604,200 | A | | 5/1898 | Vogeler | 482/61 |
| 2,623,302 | A | | 12/1952 | Shields | 434/30 |
| 3,526,042 | A | | 9/1970 | Nelson | 434/61 |
| 3,686,776 | A | | 8/1972 | Dahl | 434/61 |
| 3,871,648 | A | | 3/1975 | Maurer, III | 482/61 |
| 4,082,265 | A | | 4/1978 | Berkes | 272/73 |
| 4,415,152 | A | * | 11/1983 | Smith | 482/61 |
| 4,580,983 | A | | 4/1986 | Cassini et al. | 482/61 |
| 4,709,917 | A | | 12/1987 | Yang | 272/73 |
| 4,750,737 | A | | 6/1988 | Smith | 482/61 |
| 4,802,666 | A | | 2/1989 | Rodriqguez | 482/61 |
| 4,925,183 | A | * | 5/1990 | Kim | 482/61 |
| 4,932,651 | A | | 6/1990 | Defaux | 272/73 |
| 4,958,832 | A | | 9/1990 | Kim | 272/73 |
| 5,010,763 | A | | 4/1991 | Schneider | 73/117 |
| 5,076,792 | A | | 12/1991 | Niermann | 434/61 |
| 5,100,127 | A | | 3/1992 | Melnick et al. | 119/700 |
| 5,205,800 | A | * | 4/1993 | Grant | 482/54 |
| 5,240,417 | A | | 8/1993 | Smithson et al. | 434/61 |
| 5,314,391 | A | * | 5/1994 | Potash et al. | 482/7 |
| 5,364,271 | A | | 11/1994 | Aknin et al. | 434/61 |
| 5,385,519 | A | | 1/1995 | Hsu et al. | 482/54 |
| 5,492,516 | A | | 2/1996 | Trotter | 482/57 |
| 5,662,559 | A | | 9/1997 | Vasquez | 482/61 |

(Continued)

OTHER PUBLICATIONS

Chtistensen, Hollerbach, Xu, and Meek, "Inertial-Force Feedback for the Treadport Locomotion Interface", PRESENCE, vol. 9, No. 1, Feb. 2000, pp. 1-14.

*Primary Examiner*—(Jackie) Tan-Uyen Ho
*Assistant Examiner*—Tam Nguyen
(74) *Attorney, Agent, or Firm*—Law Offices of Timothy E. Siegel; Timothy E. Siegel

(57) ABSTRACT

A treadmill assembly that includes a frame and a treadmill belt. In addition, a sensor produces a signal representative of an aspect of the user's position relative to at least one point on the frame. A belt rotation assembly turns the belt with a speed related to the signal. In one preferred embodiment the speed of the belt is inversely proportional to the distance between the user and the front of the treadmill. In another preferred embodiment the treadmill is sized to support a cycle.

8 Claims, 3 Drawing Sheets

U.S. PATENT DOCUMENTS

| | | | | |
|---|---|---|---|---|
| 5,800,314 | A | 9/1998 | Sakakibara et al. | 482/54 |
| 5,919,119 | A | 7/1999 | Bohmer et al. | 482/54 |
| 6,004,243 | A | 12/1999 | Ewert | 482/8 |
| 6,056,672 | A | 5/2000 | Carbonell Tendero | 482/57 |
| 6,123,547 | A * | 9/2000 | Teresi | 434/61 |
| 6,123,647 | A | 9/2000 | Mitchell | 482/54 |
| 6,126,571 | A | 10/2000 | Parks | 482/4 |
| 6,126,575 | A | 10/2000 | Wang | 482/54 |
| 6,135,924 | A | 10/2000 | Gibbs et al. | 482/54 |
| 6,394,239 | B1 | 5/2002 | Carlson | 188/267.2 |
| 6,416,444 | B1 | 7/2002 | Lim et al. | 482/54 |
| 6,447,424 | B1 * | 9/2002 | Ashby et al. | 482/8 |
| 6,454,679 | B1 * | 9/2002 | Radow | 482/4 |
| 6,716,106 | B2 * | 4/2004 | Wang et al. | 472/59 |
| 6,837,830 | B2 * | 1/2005 | Eldridge | 482/54 |

* cited by examiner

BICYCLE TREADMILL HAVING AUTOMATIC SPEED AND RESISTANCE ADJUSTMENTS

BACKGROUND OF THE INVENTION

Bicycle riding is valued as exercise for many reasons. It is an outstanding way to develop aerobic and anaerobic fitness, it is the basis of a popular competitive sport, it is relaxing and therapeutic, and it is also used as a typical workload in physiology research.

But when outdoor conditions are bad (rain, ice, chill, darkness) a rider's only option is to use a stationary indoor exerciser.

Known means of indoor pedaling include a purpose built ergometer; a rider's own bicycle on a fixed stand with inertia and wind resistance; a rider's own bicycle on rollers with occasional resistance add-ons; a rider's own bicycle held upright on rollers; a rider's own bicycle held upright on a treadmill; a rider's own bicycle riding freely on a level or sloped treadmill.

Such prior art pedaling exercisers fail to provide many of the benefits of actual outdoor riding, namely, 1. Side to side tilting. Few indoor exercisers allow a bicycle to tilt naturally in response to muscular effort or steering actions. Thus they engage different muscles in power production, and degrade balancing reflexes. (So-called 'training rollers' approximate natural leaning, but their balancing differs substantially from actual bicycle riding because the dual rear-wheel supports generate significant yawing moments; and the loosely coupled front-wheel roller is subject to stability-reducing speed changes from the horizontal force of a steered front wheel.)

2. High pedaling inertia. Few indoor exercisers have enough inertia to permit riders to exert the high forces of startup or sprinting, or to use the same pulsatile pedaling style that they find effective for ordinary riding. Thus low-inertia exercise bikes de-train the rider's pedaling habits. Furthermore coasting is less feasible, because the exercise bicycle quickly comes to rest. (A few indoor exercisers have large flywheels or electronic simulation of pedal inertia, but none of these allow tilting.)

3. Fore/aft acceleration. No indoor pedaled exercisers respond to pedal thrusts with actual rider acceleration, or respond to the intensity of effort with visual or kinesthetic clues of moving faster or slower. In actual riding, such accelerations and motions provide a very natural instinctive feedback on level of effort, and are highly motivational (through feelings of pleasure, or achievement) for maintaining a given effort.

4. Hills. Those who ride seriously know that the challenge of a hill adds unique motivation and enjoyment to a rigorous training ride. A few electronic-based exercisers purport to simulate 'hills', but these are merely increases in resistance, without the upward slope, or the enhanced rearwards acceleration when coasting. No indoor pedaled exerciser provides the actual sensation of riding up a hill.

5. Air resistance (speed-dependent resisting torque) forms a natural and realistic limit to pedaling speed. It is simulated by only some exercisers, and not in combination with the other desirable features mentioned above. Realistic speed-dependent resistance helps a rider fine-tune a 'pace' that develops maximum endurance.

Many would find value in a realistic indoor bicycle-riding simulation, which faithfully reproduces all the forces and dynamics of real-world pedaling when outdoor riding isn't practical. As a further advantage, realistic machine-based cycling would permit a coach or trainer to monitor and correct a competitor's actual performance, while his effort level is consistently controlled.

One known method of implementing a stationary bicycle is to ride a bicycle on a treadmill. Treadmills have a potential to make steering and balancing perfectly realistic. However, even if a large-enough treadmill can be found, simply riding on it has disadvantages making it untenable as a practical simulation. It is an aim of the current invention to eliminate those disadvantages.

One disadvantage of this approach stems from the lack of pedaling resistance. A bicycle rider frequently applies large pedaling torque for a few seconds, resulting simply in a modest change to bicycle speed. A free bicycle on a treadmill will quickly be ridden off the front.

Another disadvantage is the typical treadmill's speed-control operator interface. A user must typically adjust the treadmill control causing the treadmill to turn faster or slower, or must accept a schedule of speeds set at the beginning of the user's exercise session. It would be virtually impossible for a bicycle rider to place his bicycle on a standard treadmill and reach the control panel of the treadmill. Moreover, although it is fairly easy for a walking/running treadmill-user to regulate his speed well enough to stay on the treadmill, this presents a far greater challenge or frustration for a high-speed cyclist.

These disadvantages no doubt explain why many of the prior art solutions show a bicycle essentially bolted in place on a treadmill. But the sensations of riding a rigidly held cycle are so different from that of riding a cycle that is free of restraint that it would actually have a negative effect on the training of the cyclist's balancing reflexes and muscular usage patterns, as well as being less pleasant and motivational. Bolting in place eliminates desirable features such as lateral tilting and fore/aft acceleration. In addition the response to pedaling torque is generally an unrealistically fixed speed. Furthermore, bolting in place makes it inconvenient to switch bicycles.

What is needed is a treadmill system that permits lateral motion and tilting of the rider for realistic balancing and power production; fore/aft acceleration and displacement of the rider for feedback and motivation; resisting forces able to absorb any applied pedal torque (part of simulating inertia); and treadmill speed control providing appropriate belt acceleration and steady state speed based on the rider's both transient and sustained effort levels (simulating aerodynamic drag, and the other part of simulating inertia).

SUMMARY OF THE INVENTION

In a first separate aspect, the present invention is a cycle riding facilitating assembly that includes a treadmill that is adapted to support a user riding a cycle, without any definite constraints of lean angle, or position on the belt surface. In addition, a sensor is adapted to produce a signal related to the cycle's fore/aft position on the treadmill, and a belt rotation assembly is adapted to rotate the belt at a speed responsive to the signal, so as to allow the rider to select any speed in the natural fashion of pedaling faster, yet without any danger of coming off the treadmill.

In a second separate aspect, the present invention is a cycle riding facilitating assembly including a treadmill having a front and including a belt having an upper surface that is adapted to support a user riding a cycle. Also, a cycle resistance assembly is adapted to exert a rearward force on the bicycle, in a way that approximates the resistive forces (inertial and aerodynamic) of actual riding, in order to mimic physical effects felt by a cyclist moving on a stationary surface. Two possibilities are a tether, or a wirelessly modulated brake attached to the bicycle wheel.

In a third separate aspect, the present invention is a method of facilitating substantially stationary cycle riding that includes having a cyclist mount a treadmill with a cycle, and start to move the belt rearward at a speed permitting the rider to balance. Then, sensing a quantity related to the cycle's position on the treadmill and moving the belt with a speed related to the value of the quantity.

In a fourth separate aspect, the present invention is a method of facilitating substantially stationary cycle riding that includes having a cycle rider mount a treadmill with a cycle having wheels slightly forward of the zero-speed point. When the treadmill is switched on, it immediately rotates the bicycle wheels at a rate sufficient for easy balancing and pedaling. The rider will move forward from there to achieve greater speed. A rearward force is applied to the bicycle in a manner adapted to mimic the effects of physical phenomena on a cyclist riding on a stationary surface.

In a fifth separate aspect, the present invention is a treadmill assembly that includes a data processing assembly and a slope adjustable treadmill responsive to the data processing assembly. In addition, a data input device may be used to indicate a physical route and the data processing assembly commands the slope adjustable treadmill to progressively alter its slope as the user uses the treadmill, in mimicry of the slopes found along the physical route.

The foregoing and other objectives, features and advantages of the invention will be more readily understood upon consideration of the following detailed description of the preferred embodiment(s), taken in conjunction with the accompanying drawings.

DETAILED DESCRIPTION OF THE PREFERRED EMBODIMENTS

Figure 1:
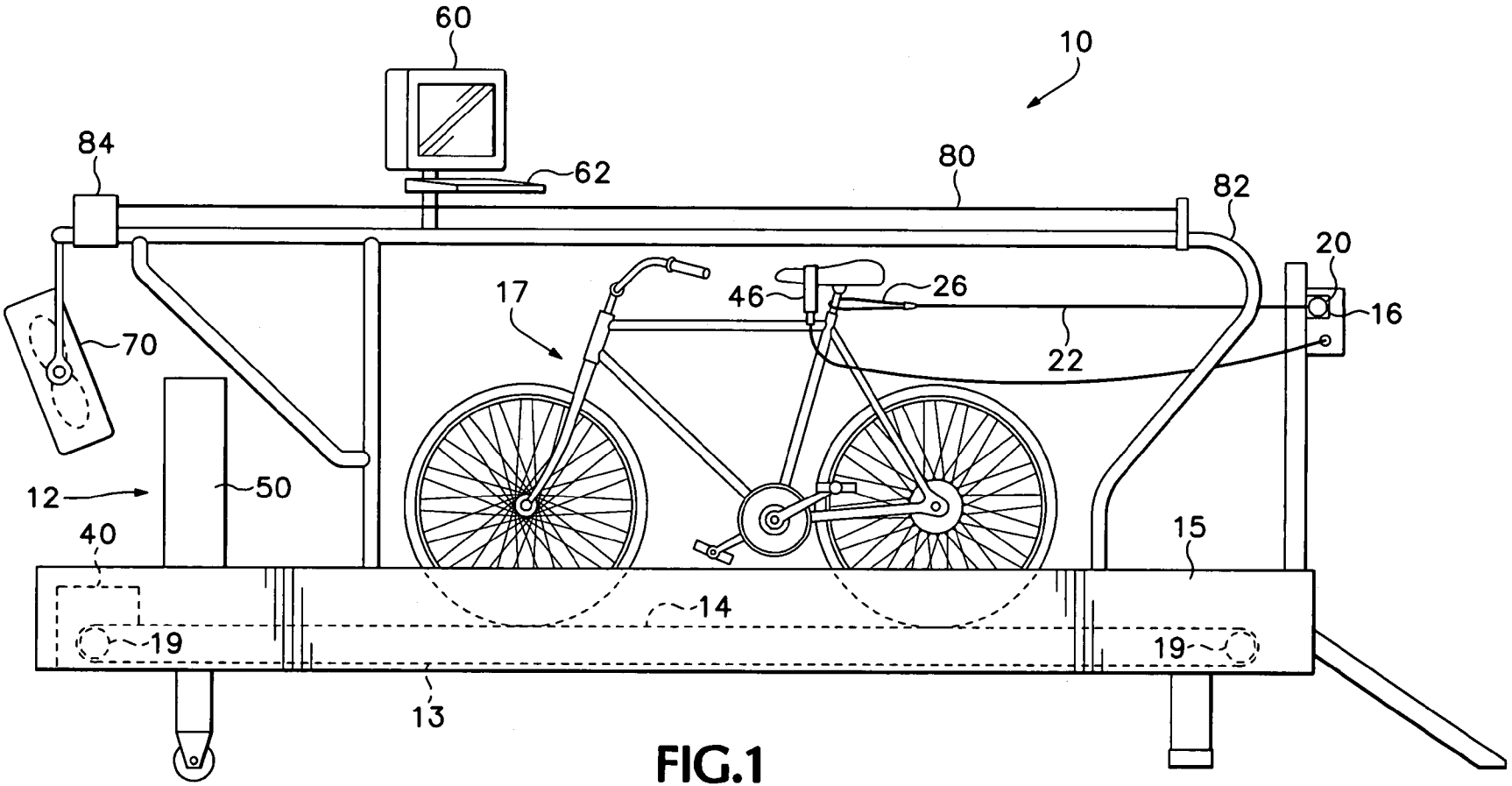
FIG. 1 is a side view of a cycle riding facilitating assembly, shown with a bicycle mounted upon it and with elements of the assembly correctly connected to the bicycle.
Figure 2:
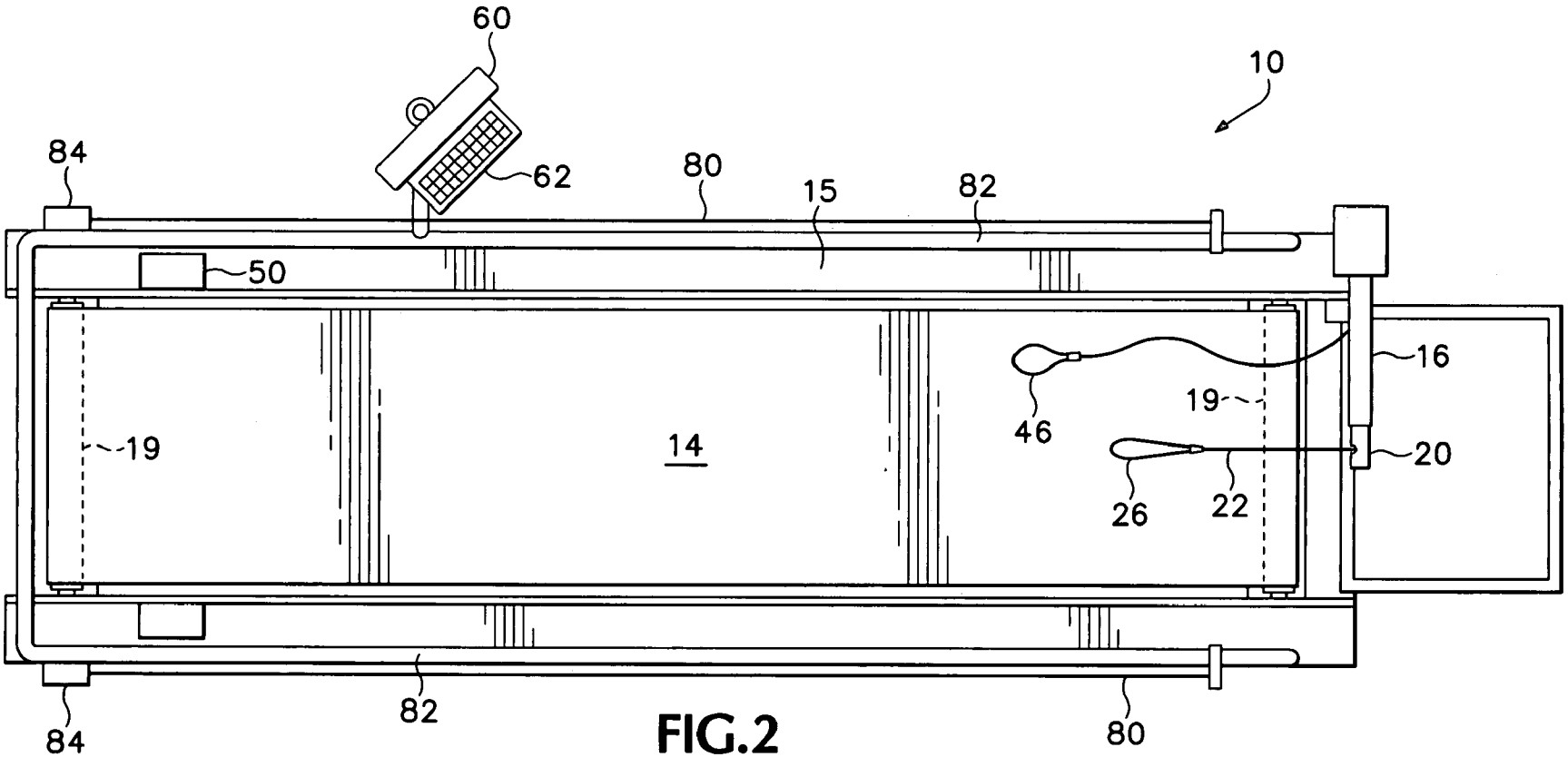
FIG. 2 is a top view of the cycle riding facilitating assembly of FIG. 1.
Figure 4:
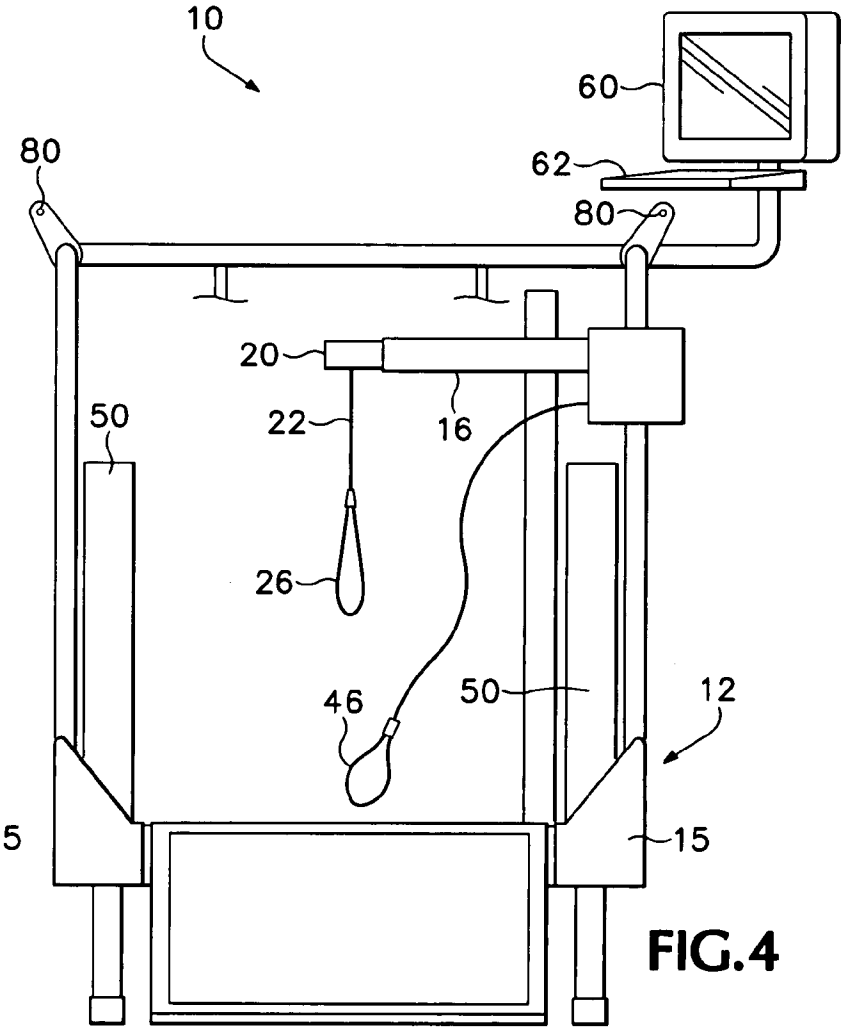
FIG. 4 is a rear view of the cycle riding facilitating assembly of FIG. 1.
Figure 3:
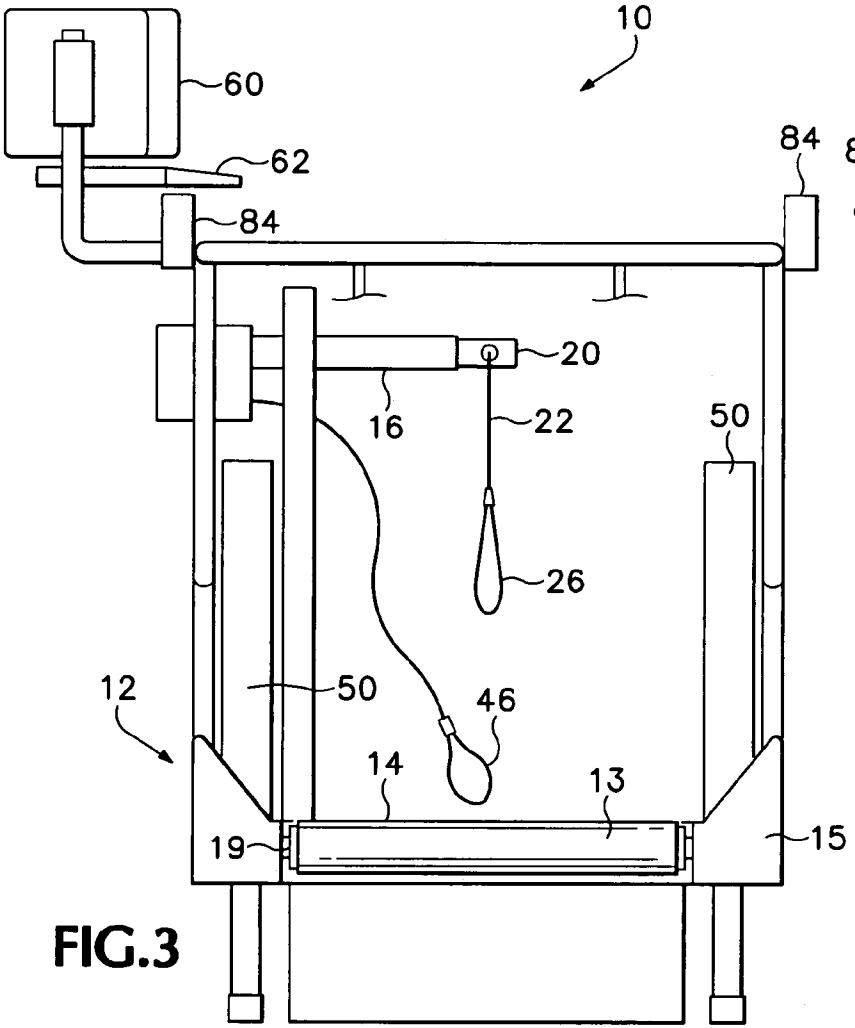
FIG. 3 is a front view of the cycle riding facilitating assembly of FIG. 1.

A cycle riding facilitating assembly 10 includes a treadmill 12 having a treadmill belt 13 that defines an upper surface 14. Belt 13 is stretched and turned by a pair of rollers 19, which are supported by a frame 15. The belt is supported by rollers to reduce heat from friction. Treadmill 12 is 3.3 meters (10 feet) long as measured from the center of rear roller 19 to the center of front roller 19. At the rear of assembly 10 an arm 16 is hinged to frame 15 so that a user may rotate the arm 16 backward to gain access to treadmill 12 with his bicycle 17 and then place the arm 16 in its forward position, transverse to treadmill 12, ready for use. If the user were to travel backward into arm 16, it would swing backward upon contact, thereby avoiding collision damage to the user.

At the end of arm 16 is a tension control assembly 20 out of which protrudes tension element or rope 22 that has a loop 26 at its end. Rope 22 is progressively retractable from assembly 20. Loop 26 is placed about the seat post of the bicycle 17. Tension control assembly 20 measures how far out of assembly 20 rope 22 has been drawn and uses this information to control a power belt rotation assembly 40. Skilled persons will recognize that the combination of tension element 22 and tension control assembly 20, comprises a sensor that measures the forward position of the bicycle 17 when loop 26 is placed about the seat post of bicycle 17. Assembly 40 turns the belt 13 at a speed determined from the rope length's variation in time. A particularly practical speed control law is simply to make belt speed proportional to the extent to which rope 22 has been pulled outwardly from assembly 20. Accordingly, the commanded belt speed is given by the following equation (1):

$$\text{Commanded Belt Speed}=C_1P \quad (1)$$

Where P equals the length of rope 22 (inches) that has been pulled out of tension control assembly 20, and $C_1$=a constant related to a rider's speed potential, designed so the rider experiences a sensation of moving ahead or back if power his/her power output is increased/decreased, while also keeping the cyclist at a comfortably middle position on the belt. A value of approximately 0.3 KM/hour/cm (0.5 mph/in) has proven effective.

In addition, tension control assembly 20 pulls on rope 22 to create a tension that mimics the various resistive forces experienced in outdoor cycling. It will be understood that the rope may be attached either to the cycle or to the rider, or both, without preventing its intended effect. One part of the rope's total tension effectively reproduces the effects of air resistance, by applying a force that is higher at greater belt velocities. A quadratic dependence on velocity is most realistic, but in practice a linear dependence has been found to be adequate. Since belt velocity is commanded to be proportional to position P, the portion of the force simulating air resistance will be a summand that is proportional either to P or to P*P. The relationship between speed and aerodynamic drag or wind resistance is well known to those skilled in the art, and the belt velocity as a function of the amount that rope 22 is pulled out from tension assembly 20 may be easily set accordingly. In one preferred embodiment a default value is provided, but may be overridden by a user, to account for that users particular aerodynamic profile. In another preferred embodiment, the rider's profile is measured by an ultrasound transceiver and the relationship between treadmill speed and tension of rope 22, is set accordingly.

Furthermore, when the rider pedals harder, it is desirable to permit some actual forward acceleration, resulting in a steady state more-forward position, while realistically resisting pedaling torques of any magnitude. The sequence of events experienced by a treadmill rider can't be entirely true to life, because a real cyclist would acquire substantial speed relative to the notionally fixed reference frame of the treadmill, and would end up a great distance ahead of it. In a small-size simulator, as is well known in the art of flight simulators, it is important to allow some initial acceleration, but then to slowly counter it to bring the rider to rest within the allowed space. At the same time, the pedals must accelerate to a new, higher velocity.

Many alternative schemes for controlling treadmill speed and rope tension would adequately provide the intended advantages. A preferred simple scheme is to recognize that commanded belt acceleration, which is responsible for the bulk of pedal rpm acceleration, is proportional to the time rate of change of P. A summand to the force output on the rope should therefore be proportional to rider mass and the rate of change of P. In practice, a value of approximately 12.2 newtons/(cm/sec) (7 pound force/[in/sec]) is close to realistic and provides a good feel.

Accordingly, the tension of rope 22 may be described as follows:

$$\text{Rope tension}=C_2P^2+C_3(\Delta P/\Delta\text{time}) \quad (2)$$

where $C_2$ is a constant chosen to create a tension crudely mimicking wind resistance which may have a default value set according to principals well known to skilled persons, and $C_3$ is a constant chosen to create tension similar to inertial resistance and may be set to 12.2 newtons/(cm/sec) (7 lbf/[in/sec]). In one preferred embodiment rope tension is updated every 0.1 seconds, and Δtime equals 0.1 seconds. Many other algorithms may be used, for example.

Although speed and tension are portrayed as commanded by calculating electronics, those skilled in the art will recognize that similar control functions can be achieved by mechanical or electronic components without recourse to a digital computer.

In practice, the actual belt speed and actual rope tension will not precisely follow the given equations. There is a lag in each of those systems, plus the estimated velocity of the rider relative to the treadmill frame is computed only approximately, and with additional delay. When a steadily pedaling rider suddenly increases torque, this leads to an initial acceleration relative to the treadmill. With some delay, the belt speeds up to match position. Meanwhile the rope tugs hard enough to limit forward motion (nearly matching pedaling effort). After a short time, and with no perceptible oscillations, the rider finds himself pedaling faster, in a slightly forward position, and supplying a greater steady state torque to maintain position. The entire process occurs quickly and feels natural.

In one preferred embodiment of assembly 10 tension control assembly 20 includes a spool (not shown) about which is wrapped a portion of rope 22. An optical-electric spool angular measurement device reads the angle of the spool to an accuracy of 0.0005 rotations. This information is sent to a data processing unit (not shown), which commands a torque servo to place a particular torque on the spool. Those skilled in the art will readily recognize that spool torque translates directly into tension on rope 22.

The effect of this arrangement is that the rider may begin riding without pressing a button to choose an initial speed, as must be done with conventional treadmills. As the rider attempts to ride faster (relative to belt surface 14), he goes further forward, causing the belt 13 to speed up. This simultaneously links higher power to faster pedaling speed, and gives a visual indication of working harder. As he reduces pedaling force, hence tractive effort of the drive wheel, various forces including the tension on rope 22, any slope of treadmill belt 12 (see below) and rolling resistance combine to pull the bicycle backwards relative to the frame, which slows down the belt 12. If he maintains a steady power, his position will adjust such that belt 12 speed times resistive forces is in perfect balance, and rider position and belt 12 speed will thereafter remain steady. Accordingly, the rider may speed up and slow down according to his own pedaling effort without pushing any buttons, while enjoying the feel and visual feedback of fore/aft motion. Those skilled in the art will readily recognize that there are many ways of measuring a user's position on a treadmill, including the use of sonar, light beams or a laser range finder. In an additional preferred embodiment the user's velocity or acceleration relative to the frame is also used in the algorithm to control the belt speed.

In addition, a rider seating sensor 46 determines whether the cycle rider is seated or standing. If the rider is standing, tension control assembly 20 reduces the variation of belt speed as a function rope 22 withdrawal (about the speed of the belt 12 at the time when the rider stood up), so that so that small fore/aft motions will cause only muted changes in belt speed, as cyclists tend to pedal with a greater variation in force when standing. If not accommodated, this variation would cause a distracting oscillation in belt speed.

In addition, a slope or tilt assembly 50 is able to lift up the front portion of treadmill frame 15 for the purpose of imparting a slope to the treadmill. When this is done, a message is sent to the tension control assembly 20 notifying assembly 20 of the degree of tilt. The tension control assembly then changes the value of $C_1$ in equation (1) so that the cyclist, who will naturally move at a slower speed than he would move if on a level surface, does not fall back to an uncomfortably rearward position on surface 14. Tension control assembly 20, which includes a data processing element (not shown) may be programmed adapt to a cyclist by decreasing the value of $C_1$ for a slow cyclist to gradually move the cyclist forward toward the middle of surface 14. Likewise for a fast cyclist the value of $C_1$ would be increased to move the cyclist backward, also toward the middle of the belt 12. In one embodiment, a cyclist inputs a self-designating code (e.g. his name) into assembly 10 when he begins cycling by way of a data input device 62, so that the tension control assembly 20 will have advance knowledge of whether he is a slow or fast cyclist, from his previous cycling sessions.

If the treadmill has no tilting capability, hills can be simulated by adjusting rope tension according to a pre-arranged program.

A computer display screen 60 permits a user to see a hill profile. Display screen 60 may also be used, in conjunction with computer memory, to display a topographic map to the user, who may then use data input device 62 to pick a route that is simulated by the slope or tilt control of the treadmill.

In one embodiment, there is no active motor 40 turning the treadmill, but rather the power from the cycle 17 turns the treadmill, with element 40 taking the form of a resistive assembly, to resist the belt rotation in order to implement equations (1) and (2). The resistance to the turning of belt 13 plus the slope of the treadmill create the tension on rope 22, which may be elastic, or wound about a spring loaded spool, to provide some fore/aft displacement. In one preferred embodiment of this type the treadmill speed is controlled either: (a) by the pedaler's propulsive force driving a flywheel and fan connected to the belt (b) or by measuring propulsive force with a load cell and using the resulting signal to brake treadmill motor speed.

A fan 70 is used to cool the cyclist and provide genuine wind resistance, using assembly 10. In one preferred embodiment fan 70 is responsive to control assembly 20 to blow air harder if rope 22 is pulled out farther from assembly 20, indicating a faster speed. A pair of safety cords 80, stop the progress of belt 13 if pulled outwardly from break box 84.

As a further preferred embodiment, all connection of the bicycle to the treadmill frame can be eliminated. Rider position relative to the frame is sensed by sonar rather than a rope. The resistive force analogous to computer-controlled rope tension is provided by a brake on the bicycle wheel. To modulate this brake in accordance with desired equations, a radio transmitter commands brake intensity to a corresponding receiver mounted on the brake. The battery powered brake unit is connected to the bicycle by dropping into place without bolts.

Although the cycle riding facilitating assembly 10 certainly finds a good application in the facilitation of bicycle riding and in one preferred embodiment is sized for this activity, with initial values of $C_1$ and $C_2$ chosen accordingly, in another preferred embodiment assembly 10 is adapted for facilitating the riding of a motorcycle. Accordingly, in the context of this application "cycle" can refer to a bicycle or a motorcycle, or even a tricycle.

The terms and expressions that have been employed in the foregoing specification are used as terms of description and not of limitation. There is no intention, in the use of such terms and expressions, of excluding equivalents of the features shown and described or portions thereof, it being recognized that the scope of the invention is defined and limited only by the claims which follow.

The invention claimed is:

1. A free motion bicycle riding facilitating assembly, comprising:

(a) a treadmill having a front and including a belt having an upper surface that is adapted to support a user riding a bicycle, said cycle having a limited range of forward and rearward movement 15 cm (½ foot) while on said treadmill;

(b) a sensor adapted to produce a signal related to said bicycle's present and previous positions on said treadmill;

(c) a belt rotation assembly adapted to rotate said belt at a speed responsive to said signal;

(d) a motion-allowing force application device, adapted to apply a controlled rearward force on the bicycle, responsive to said signal, without preventing fore/aft motion, wherein said device is controlled so as to mimic physical effects felt by a cyclist on a stationary surface, where such effects include inertial resistance and wherein inertial resistance to actual fore/aft motion comprises a portion of the total apparent inertial resistance felt by an assembly user; and (e) wherein said motion allowing rearward force application device applies a rearwards force to a bicycle or rider on said belt in approximate proportion to said bicycle's acceleration relative to said belt upper surface, simultaneously with said bicycle's actual forward motion through said limited range of movement, in order to mimic the effects of inertia on said bicycle and rider.

2. The free motion bicycle riding facilitating assembly of claim 1 wherein said signal is more specifically representative of said bicycle's forward position on said treadmill.

3. The free motion bicycle riding facilitating assembly of claim 1 wherein said signal is more specifically representative of a bicycle forward position on said treadmill, combined with said bicycle's change in forward position over a period of time, which may also be referred to as "speed" relative to said treadmill.

4. The free motion bicycle riding facilitating assembly of claim 1 wherein said signal is more specifically representative of a bicycle's change in speed over a period of time, which may also be referred to as "acceleration" relative to said treadmill.

5. The free motion bicycle riding facilitating assembly of claim 1 further including a tilt mechanism for imparting a degree of tilt to said belt, to present a slope to said user and wherein said belt rotation assembly responds to said tilt mechanism by altering said response of said belt speed to said signal, according to said degree of tilt.

6. The free motion bicycle riding facilitating assembly of claim 1 wherein said motion allowing rearward force application device acts on a bicycle positioned on said belt, with an intensity approximately related to the said bicycle's velocity, relative to said belt upper surface in proportion to the square of said bicycle's velocity relative to said belt upper surface, in order to mimic the effect of wind resistance on said bicycle and rider.

7. The free motion bicycle riding facilitating assembly of claim 1 wherein said motion allowing rearward force application device acts on a bicycle positioned on said belt, with an intensity approximately related to the said bicycle's velocity, relative to said belt upper surface in proportion to the square of said bicycle's velocity relative to said belt upper surface, in order to mimic the effect of wind resistance on said bicycle and rider.

8. A free motion bicycle riding facilitating assembly, comprising:

(a) a treadmill having a front and including a belt having an upper surface that is adapted to support a user riding a bicycle, said bicycle having a limited range of forward and rearward movement 15 cm (½ foot) while on said treadmill;

(b) a sensor adapted to produce a signal related to said bicycle's present and previous positions on said treadmill;

(c) a belt rotation assembly adapted to rotate said belt at a speed responsive to said signal;

(d) a motion-allowing force application device, adapted to apply a controlled rearward force on the bicycle, responsive to said signal, without preventing fore/aft motion, wherein said device is controlled so as to mimic physical effects felt by a cyclist on a stationary surface, where such effects include inertial resistance and wherein inertial resistance to actual fore/aft motion comprises a portion of the total apparent inertial resistance felt by an assembly user; and (e) a sensor adapted to determine whether a user is standing or sitting on a bicycle positioned on said belt and wherein said belt rotation assembly responds to said signal differently depending on whether said user is sitting or standing on said bicycle.

* * * * *